US011634308B2

(12) United States Patent
Benz

(10) Patent No.: US 11,634,308 B2
(45) Date of Patent: Apr. 25, 2023

(54) LIFTING PLATFORM

(71) Applicant: Gerhard Finkbeiner, Freudenstadt (DE)

(72) Inventor: Dieter Benz, Alpirsbach (DE)

(73) Assignee: Gerhard Finkbeiner, Freudenstadt (DE)

( * ) Notice: Subject to any disclaimer, the term of this patent is extended or adjusted under 35 U.S.C. 154(b) by 869 days.

(21) Appl. No.: 16/603,691

(22) PCT Filed: Apr. 10, 2018

(86) PCT No.: PCT/EP2018/059089
§ 371 (c)(1),
(2) Date: Oct. 8, 2019

(87) PCT Pub. No.: WO2018/189140
PCT Pub. Date: Oct. 18, 2018

(65) Prior Publication Data

US 2020/0115204 A1 Apr. 16, 2020

(30) Foreign Application Priority Data

Apr. 13, 2017 (DE) ..... DE102017108068.6

(51) Int. Cl.
*B66F 7/06* (2006.01)
*B66F 7/28* (2006.01)

(52) U.S. Cl.
CPC ..... *B66F 7/0641* (2013.01); *B66F 7/28* (2013.01); *B66F 2700/123* (2013.01)

(58) Field of Classification Search
CPC ..... B66F 7/28; B66F 7/0641; B66F 2700/123
See application file for complete search history.

(56) References Cited

U.S. PATENT DOCUMENTS 4,084,790 A * 4/1978 Molnar ..... B66F 7/02 254/90
4,798,266 A 1/1989 Finkbeiner
(Continued)

FOREIGN PATENT DOCUMENTS

CN 105 035 998 A 11/2015
DE 36 05 650 C2 10/1994

OTHER PUBLICATIONS

International Search Report and Written Opinion for corresponding Patent Application No. PCT/EP2018/059089 dated Jul. 23, 2018.

*Primary Examiner* — Seahee Hong
(74) *Attorney, Agent, or Firm* — Renner, Otto, Boisseile & Sklar, LLP

(57) ABSTRACT

The invention relates to a lifting platform, in particular moveable lifting platform, for lifting vehicles with two base assembly halves (14), which are respectively firmly arranged to one another with a middle part (15) via a connecting point (45, 46), wherein the middle part (15), with a connecting section (48), is detachably fastened to a lateral surface (49) of a housing (21) of the base assembly half (14) to form the connecting points (45, 46) with, respectively, a lifting device (24) arranged on the base assembly half (14), which device is transferable from a starting position arranged on the base into a working position (32), and which respectively comprises a carrier (31) on an end region of the lifting device (24), and each carrier (31) receives at least one support arm (34), wherein the middle part (15) is connected with the respective housing (21) of the base assembly half (14) with one another and are aligned with respect to each other through a form-fit plug connection (51).

19 Claims, 8 Drawing Sheets

(56) References Cited

U.S. PATENT DOCUMENTS

Figure 1:
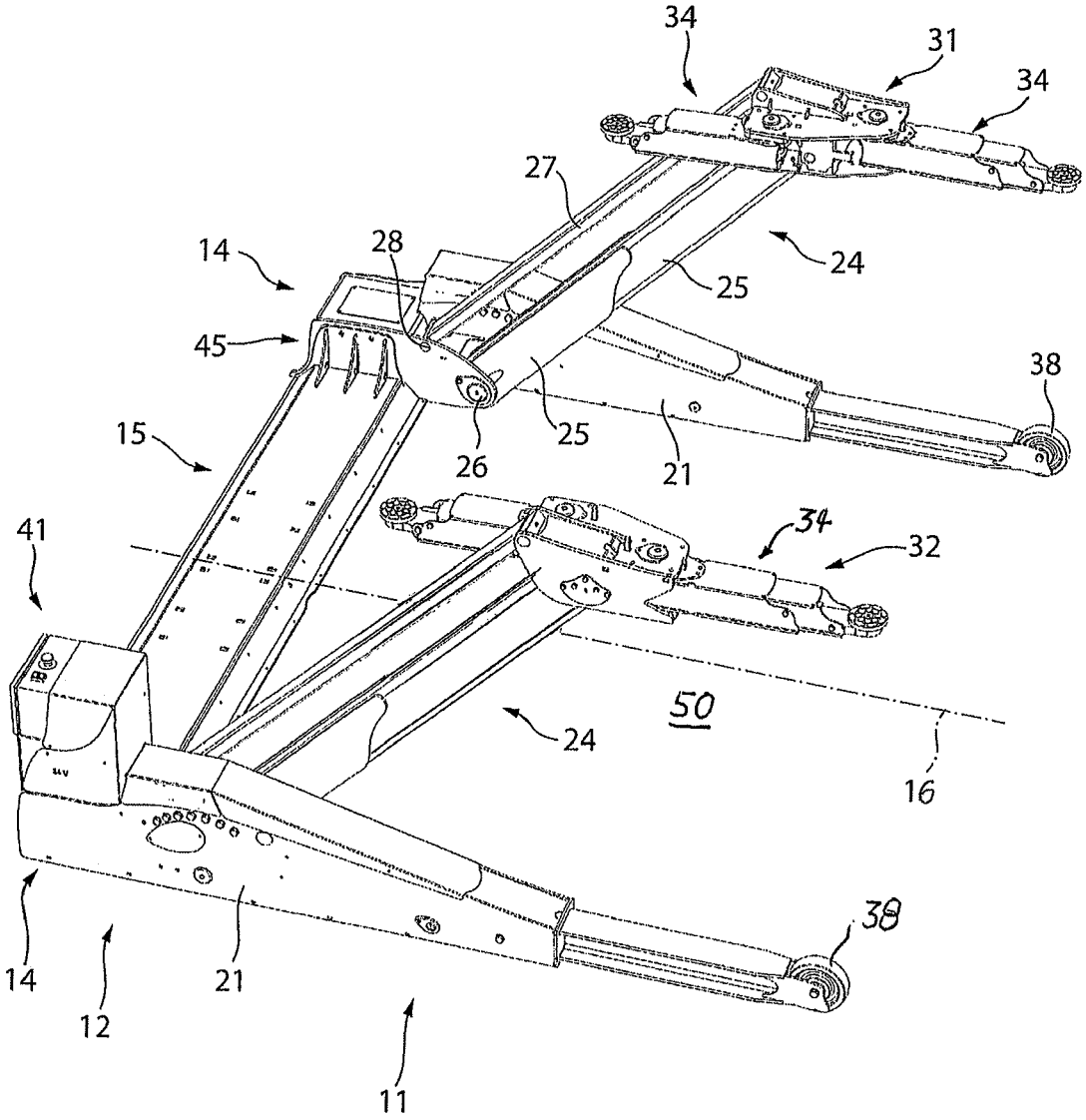

| | | | | |
|---|---|---|---|---|
| 2004/0011594 | A1 | 1/2004 | Stewart | |
| 2008/0101898 | A1* | 5/2008 | Hernandez | B66F 7/0625 414/426 |
| 2015/0232308 | A1* | 8/2015 | Uhl | B66F 7/16 254/89 R |

* cited by examiner

LIFTING PLATFORM

The invention relates to a lifting platform, in particular moveable lifting platform, for lifting vehicles.

A mobile hydraulic lifting platform for lifting vehicles in overhead height is known from DE 36 05 650 C2. This mobile lifting platform includes a base assembly which rests stationary in the lifting of vehicles. In non-use, this lifting platform can be moved, by means of a carriage, into a further use or storage position. The base assembly of the lifting platform includes two base assembly halves, as well as a middle part, wherein the two base assembly halves are firmly connected with each other and arranged to one another via the middle part. Each base assembly half comprises a drive, via which a parallelogram guiding device of the base assembly half is movable up and down. This parallelogram guiding device includes a load arm and a guide rod, so that a carrier arranged on the free end region remains horizontally oriented when raising and lowering the parallelogram guiding device. The carrier provided on the parallelogram guiding device receives two support arms pivotably arranged on the carrier. These support arms can be pivoted out of a non-use position, in which the support arms are oppositely oriented and positioned parallel to the parallelogram guiding device, into a use position, in order to lift up a vehicle driven in between the base assembly halves and into the lifting platform.

Each base assembly half is fastened to the middle part, which is configured in the form of a protective tube. The middle part comprises a flange portion at the respective end, which portion is screwed to a lateral surface of the housing of the base assembly half.

The requirements on the rigidity of such lifting platforms, as well as the orientation of the lifting devices of the lifting platform to each other is steadily increasing.

The invention is based on the object of proposing a lifting platform, in which the rigidity of the base assembly is increased and the mounting of the base assembly and in particular the adjustment of the orientation of the lifting devices is simplified.

This object is achieved by a lifting platform for lifting vehicles, in which the middle part is connected with the respective housing of the base assembly halves for forming the base assembly by a form-fit plug connection. An increased transmission of force may thereby be made possible, as an improved flow of force is made possible by the form-fit engagement of the connecting elements with each other. At the same time, an independent orientation with respect to each other can occur, in a simple way, in the assembly of the middle part to the housing of the base assembly halves. Preferably, the form-fit plug connection includes at least a first connecting element in a region near the base and, preferably end-facedly on the middle part, at least one further connecting element on the housing, in particular on a lateral surface of the housing of the base assembly half, wherein the at least one further connecting element is configured complementarily to the first connecting element. A simple and secure assembly can thereby be achieved by the bringing together of the middle part to the housing of the base assembly half and, supplementary in the bringing together of the middle part to the housing, a correctly positioned orientation can already occur.

Preferably, the connection elements form a form-fit plug connection loadable with tensile forces. An increased rigidity of the lifting platform can thereby be achieved. In lifting of a vehicle, the carriers are lifted by means of the lifting device into a working position. Here, a leverage force acts on the lifting device in the direction of a longitudinal center axis of the lifting device and generates a torque acting to the longitudinal center axis. Through the form-fit plug connection, this torque can be counteracted in a region near the base between the middle part and the respective housing of the base assembly half. Additionally detachable fastening means can be dispensed with. Through this form-fit plug connection, a stiffening of the base assembly can be achieved.

One of the two connecting elements of the form-fit plug connection is preferably configured by a hook or a web, and the other connecting element through an eyelet or an opening. The first and second connecting element, or the one and the other connecting element are thereby insertable into one another or hookable into one another in a simple manner, whereby an easy mounting and demounting of the middle part to the housing of the base assembly half is achieved. At the same time, a traction force acting on the form-fit plug connection can be taken-up without additional components.

A preferred configuration of the lifting platform provides for the one or the first connecting element at a lower side of the middle part, which element protrudes outwards from the connecting section of the middle part, and the second or other connecting element on the lower side of the housing of the base assembly half, in particular the lower side or end-face of a lateral side of the housing. This arrangement of the form-fit plug connection to the lower side of the middle part and of the housing of the base assembly half allows for an increased absorption of force and thus an increased load capacity. Additionally, such a form-fit plug connection can be integrated into the base assembly of the lifting platform without additional installation space.

Alternatively, the first connecting element can be provided on a lower side of the middle part, which element adjoins to the connecting section of the middle part. The second connecting element is provided on the lower side of the housing, which element projects outwardly from the end-face of the housing. In such an embodiment, the middle part is mountable to the housing from above, and the connecting elements engage in one another.

Preferably, the first connecting element, which is arranged on the lower side of the middle part, is configured as an eyelet or opening, and the second connecting element, arranged on the lower side of the end-face of the housing, is configured through at least one hook or web so that, when mounting the housing of the base assembly half to the middle part, the at least one hook or web engages into the at least one eyelet or opening. This can occur through a simple insertion from above. Depending upon the arrangement as to whether the first connecting element is configured protrudingly at the middle part or at the housing of the base assembly half, the insertion from above can occur through the middle part or the housing in order to achieve the form-fit plug connection.

Preferably, the connecting elements are integrally integrated on the middle part and the housing of the base assembly halves. This simplifies the production and reduces the number of components for the base assembly.

Moreover, the end-faced connecting section preferably comprises a pressure surface at the middle part, which is provided spaced from the form-fit plug connection and engages on a lateral surface of the housing of the base assembly half. This pressure surface counteracts a torque acting towards the longitudinal center axis of the lifting platform in a loading of the lifting platform in a working position. The torque or titling moment acting on the middle part, via the support arms, in the lifting of a vehicle can thereby be counteracted, for one, through the pressure surface acting on the middle part and, for another, by the form-fit plug connection receiving the traction force.

Moreover, the pressure surface, at the connecting section of the middle part, acts on an upper border region of the lateral surface of the housing. An enlarged counterforce can thereby be achieved in that the lever arm is maximized between the acting pressure force and the traction force.

Moreover, at least one adjusting element is preferably arrangeable between the lateral surface of the housing of the base assembly half and the connecting section of the middle part and distanced from the connecting elements, through which element a right-angled orientation of the lifting platform to the middle part is settable. The form-fit plug connectors, in the mounting of the housing of the base assembly half, to the middle part, preferably have a low clearance. Opposite this form-fit plug connection, at least one adjusting element is disposed on the connecting point. A perpendicular orientation of the lifting device to the middle part is thereby made possible. Preferably, multiple adjusting elements are provided, which are configured in the form of a strip or platelet and can be provided in differently thick dimensions. In the assembling together of the middle part with the housing of the base assembly half, a pre-mounting position, in which the lifting device is slightly inclined in the direction towards the longitudinal center axis of the lifting platform, can initially be occupied. Through the positioning of the adjusting element(s) between the pressure surface of the middle part and the lateral surface of the housing, an orientation into a vertical position to the middle part can be made possible and, simultaneously, the minimum play existing, if applicable, in the pre-mounting position can be eliminated.

Moreover, the middle part is preferably secured to one another respectively with the housing of the base assembly half through at least one detachable fastening means. This at least one detachable fastening means is preferably provided distanced from the form-fit plug connection on the connecting point. In particular, the at least one detachable connecting means is provided in the region of the pressure surface of the middle part. This at least one detachable fastening means is attached after the orientation of the lifting device, in order to fix the middle part to the respective housing of the base assembly half. The adjusting element(s), which are disposed in the connecting point, are thereby simultaneously fixed. The oriented position of the lifting device to the base assembly can thus be maintained even during a displacement movement of the moveable lifting platform. The at least one detachable fastening means serves as an assembly lock between the middle part and the housing of the base assembly half, and not for force absorption or force transmission.

Moreover, the lifting device is preferably configured as a parallelogram guiding device or scissoring guide device, in particular as half-scissors, scissors, or double scissors, which at least comprises a load arm and a guide arm, which receive the carrier at their free ends opposite the base assembly half. The lifting device can be selected dependent upon the application.

Moreover, preferably at least one drive is provided in or on the at least one base assembly half. The number of the drives and/or the positioning of the drives can, in turn, be dependent upon the maximum load to be supported and/or the construction size of the lifting platform.

Figure 2:
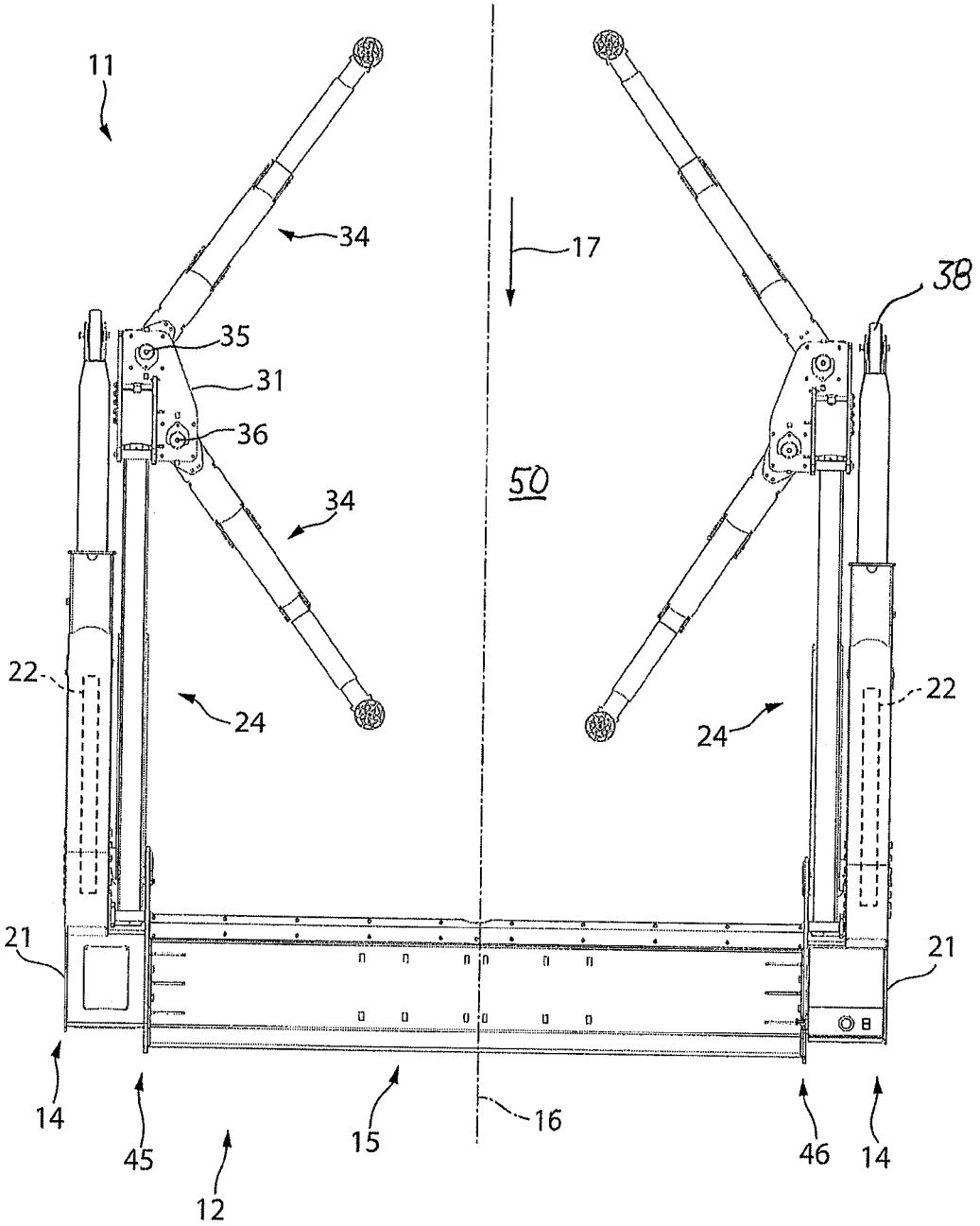
Figure 3:
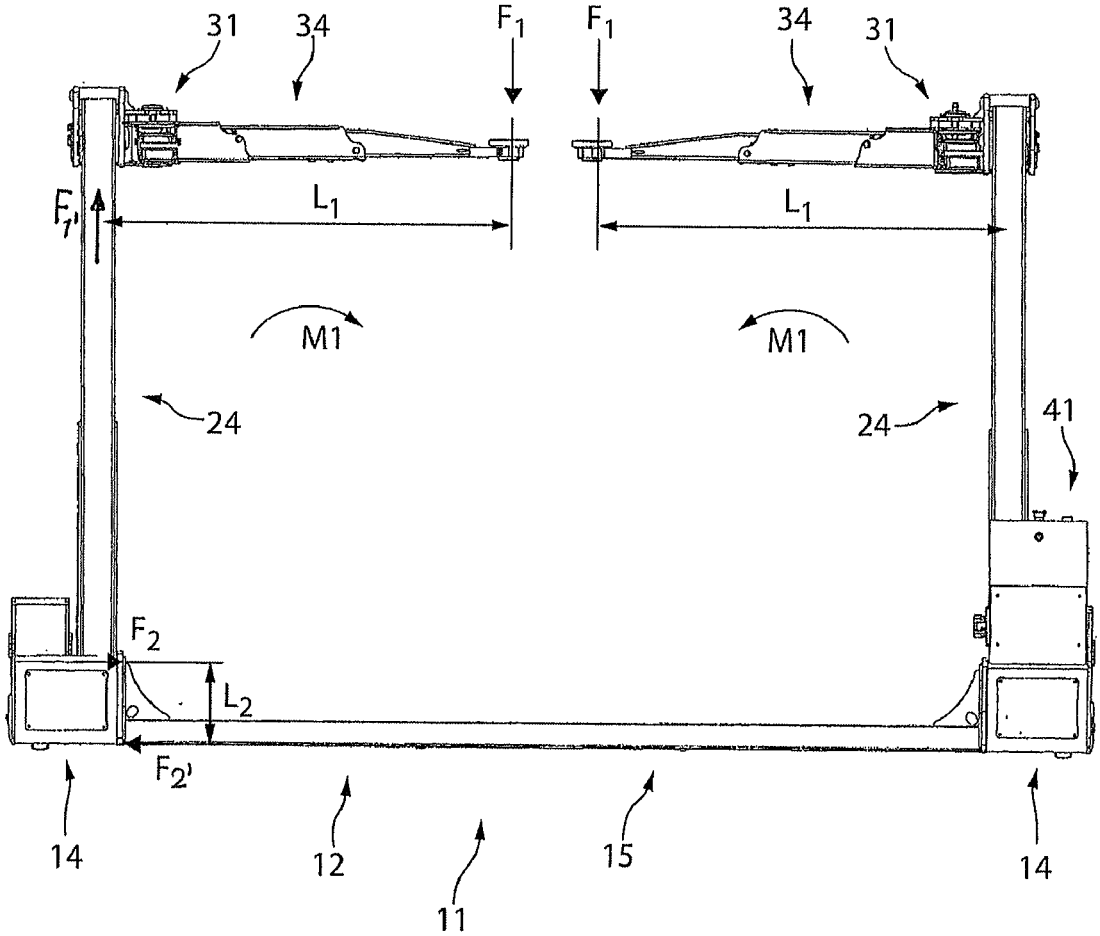

The invention, as well as further advantageous embodiments and developments of the same are disclosed and described in more detail below based on the examples illustrated in the drawings. The features to be taken from the description and the drawings may be applied individually or in any combination according to the invention. The figures show in:

FIG. 1 a perspective view of the moveable lifting platform according to the invention, FIG. 2 a schematic view onto the lifting platform of FIG. 1, FIG. 3 a schematic view from the front onto the lifting platform according to FIG. 1, FIG. 4 a perspective view onto the connection of a middle part to a base assembly half of the base assembly according to the lifting platform in FIG. 1, FIG. 5 a perspective view from below onto the connection of the middle part to the housing of the base assembly half, FIG. 6 a perspective view onto an end face of the middle part, FIG. 7 a schematic sectional view of the connecting point of the middle part and the housing of the base assembly half, FIG. 8 a perspective view onto a lateral surface of the housing of the base assembly half, FIG. 9*a* further perspective view onto the connecting point of the middle part to the base assembly half, FIG. 10 a perspective sectional view onto the middle part, and FIG. 11 a perspective view from below onto an alternative embodiment of the connecting of the middle part to the housing of the base assembly, to FIG. 5.

FIG. 1 shows a perspective view of a lifting platform 11 according to the invention. This lifting platform 11 includes a base assembly 12 which includes two base assembly halves 14 and a middle part 15 arranged therebetween. Through the middle part 15, the base assembly halves 14 are distanced and aligned to each other, preferably parallelly. Through the base assembly halves 14 and the middle part 15, a U-shaped base assembly 12 is formed. The open region represents an entry region in a working space 50 for a vehicle, which enters for so long until it is positioned near the middle part 15. The direction of entry is represented in FIG. 2 according to arrow 17 in the plan view onto the lifting platform 11. The direction of entry lies in the region of a longitudinal center axis 18 of the lifting platform 11. The longitudinal center axis 18 extends parallel between the two base assembly halves 14 and is arranged centrally thereto. The working space 50 is formed at least between the two base assembly halves 14.

Each base assembly half 14 comprises a housing 21, within which a schematically illustrated drive 22 is provided. Moreover, every base assembly half 14 receives a lifting device 24. In the exemplary embodiment, this lifting device 24 is configured as a parallelogram guiding device. The at least one drive 22 raises and lowers the lifting device 24. This lifting device 24 includes a load arm 25, which is pivotable about a first pivot axis 26. Moreover, the lifting device 24 includes a guide arm 27 which is pivotable about a second pivot axis 28 which is distanced from the first pivot axis 26. Both pivot axes 26, 28 are mounted on the housing 21.

The lifting device 24 comprises a carrier 31 at an end region distanced from the housing 21, which remains horizontally oriented through the lifting device 24 during the raising and lowering of the lifting device 24. In FIG. 1, the lifting devices 24 are provided in a working position 32. Such a working position 32 can correspond to an overhead height. In a non-use position, the lifting devices 24 are oriented near to the base or positioned resting on the base.

Each carrier 31 receives at least one support arm 34. Preferably, two support arms 34 respectively are provided on the carrier 31. These support arms 34 are pivotably mounted respectively about a bearing axis 35, 36. The support arms 34 can be configured of equal length. Alternatively, the rear support arm, facing to the entry region, can be configured longer than the, in particular, front support arm 24 facing to the middle part 15. The support arms 34 are preferably formed as telescoping support arms.

The lifting platform 11 is preferably configured as a moveable lifting platform 11. Each base assembly half 14 preferably comprises a roller 38 at an end distanced from the middle part 15, which roller is part of a carriage. Moreover, a not further illustrated drawbar can be fastenable, in a middle region, to the middle part 15, so that after lifting the middle part, the lifting platform 11 supports itself upon a wheel of the drawbar and the two rollers 38. The lifting platform 11 is thereby mobile and can be movable to the respective site of use. After the removal of the drawbar, this lifting platform 11 is stationary and rests upon the base.

Alternatively, the lifting platform 11 can also be configured as a stationary lifting platform. In this case, the rollers 38 can be dispensed with.

To actuate the lifting platform 11 out of a non-use position into a working position 32, a controller 41 is provided which is arranged on one of the two base assembly halves 14, for example. This controller 41 can output a control signal to the respective drive(s) 22. The drive 22 can be a hydraulic cylinder which can be electrically actuated. A drive 22 is preferably provided in each housing 21 of the base assembly half 14. The controller 41 includes monitoring sensors for synchronization of the lifting and lowering movement of the respective lifting device 24. On the one hand, control lines can be guided from the controller 41 into the directly assigned base assembly half 14. On the other hand, control lines can be guided within the middle part 15 to the opposite base assembly half 14.

The base assembly 12 includes a first and second connecting point 45, 46, whereby the middle part 15 can be mounted and demounted to the respective base assembly half 14. Via this connecting point 45, 46, the acting forces, in the lifting of the vehicle, are introduced from the base assembly half 14 into the middle part 15. In FIG. 3, the force F1 is illustrated, for example, which acts on the support arms 34. This force F1 symbolizes a raised vehicle in a working position 32. The length of the lever arm L1 is established through the pivoting position of the support arm 34 to the carrier 31. A torque M1 or a tilting moment of the lifting device 24 in the direction of the longitudinal central axis 16 results therefrom, which torque or tilting moment is generated by the load arm L1 and the force F1. The connecting point 45 counteracts this moment M1 with a pressure force F2, with the lever arm L2, via the housing 21 of the base assembly half 14, on the connecting section 48 of the middle part 15. The same applies for the connecting point 46.

Figure 4:
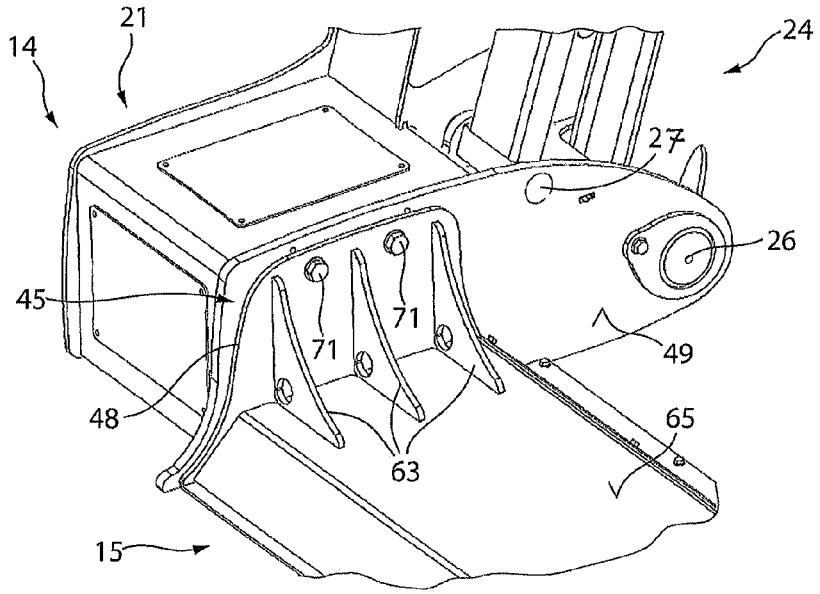

In FIG. 4, a perspective view from above onto the connecting point 45 is illustrated. FIG. 5 shows a perspective view of the connecting point 45 from below. This connecting point 45 is configured identically to the connecting point 46.

The connecting point includes a connecting section 48 at the respective end region, which section engages on the lateral surface 49 of the housing 21. A form-fit plug connection 51 is provided to connect the middle part 12 to the housing 21. This plug connection 51 is preferably configured to receive the traction force F3. This form-fit plug connection 51 includes a first connecting element 52, as well as a second connecting element 53, which can be inserted into one another and engage one another in a form-fit manner. The first connecting element 52 is configured, for example, through openings 55, in particular a closed opening. The second connecting element 53 is configured, for example, by webs 56. Here, the openings 55 are slightly larger than the webs 56, so that these webs easily engage into one another, when inserted. The openings 55 are preferably flattened, wherein the flattened portion 57 is oriented orthogonally to the traction force direction F3 and counteracts the force action direction F3. The webs 56 rest on this flattened portion 57.

It is to be understood that the configuration of the first and the second connecting element 52, 53 can also be provided in a reversed manner.

The form-fit plug connection 51 is provided in a region near the base on the connecting point 45. The first connecting element 52 is integrated into a base plate 59 of the middle part 15. The base plate 59 extends beyond the connecting section 48 in the direction towards the housing 21. The second connecting elements 53, configured as webs 56, are preferably provided on a lower end face 61 of the lateral surface 49 of the housing 21. Through a simple placement of the housing 21 onto the base plate 59, the second connecting element 53 thereby engages into the first connecting element 52 and is arranged in a form-fit manner.

The connecting section 48 of the middle part 12 preferably extends vertically upwardly from a base plate 49, wherein the height of the connecting section 48 corresponds to or is slightly lower than the height of the lateral surface 49 of the housing 21. Reinforcing ribs 63 are provided for the stiffening of the connecting section 48, which support themselves, on the one hand, on an upper side 64 of the middle part 15 and, on the other hand, on the connecting section 48 protruding freely from the middle part 15.

Figure 6:
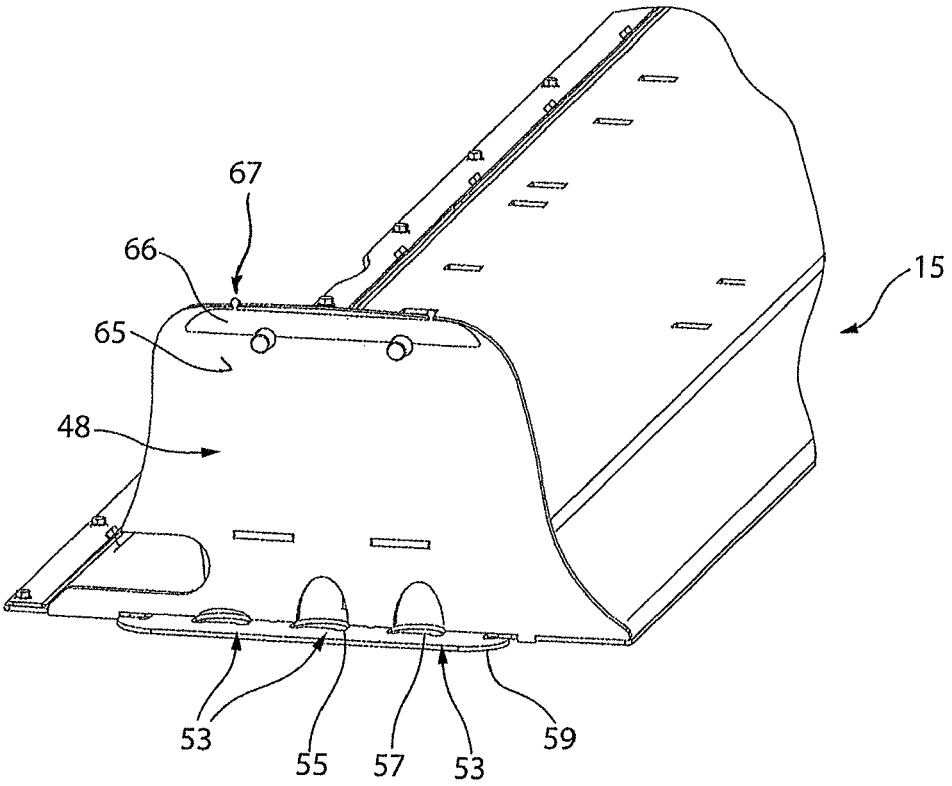

In FIG. 6, a view onto the connecting section 48 of the middle part 15 is illustrated. The connecting section 48 is configured as level bearing surface which rests on the lateral surface 49. The base plate 59 protrudes, in sections, outwardly from the connecting section 48, wherein the first connecting elements 52 are formed in the lower corner region between the base plate 59 and the connecting section 48.

A pressure surface 65 which receives the force F2 is configured in the upper region of the connecting section 48.

At least one adjusting element 66 is provided opposite of the first connecting element 52. This adjusting element 66 can be fastenable to the connecting section 48. Fold-downable tabs 67 can be provided, for example, so that the adjusting element 66 is fixable onto the upper edge region of the connecting section 48. The adjusting element 66 is configured strip- or plate-shaped.

Preferably, multiple adjusting elements 66 with same and/or different thickness are provided. An orientation of the lifting device 24 can occur perpendicularly to the middle part 15 through the adjusting element(s) 66. The form-fit plug connection 51 in the lower region of the connecting point 45, 46 represents a manner of fixed bearing so that, through the arrangement of the adjusting element(s) 66, the orientation in the angular position or in the perpendicular of the base assembly half, in particular of the lifting device 24, to the middle part 15 is settable.

The connection of the middle part 15 on the housing 21 to the base assembly half 14 occurs through detachable fastening means 71. These can, for example, be configured as screw connection. The detachable fastening means 71 serve merely for fixing the middle part 15 to the respective housing 21 of the base assembly half 14. The transmission of force from the middle part 15 onto the housing 21 occurs, on the one hand, via the form-fit plug connection 51 and, on the other hand, in an upper region of the connecting sections 48, on which the pressure surface 65 is configured to counteract the pressure force F2.

Figure 7:
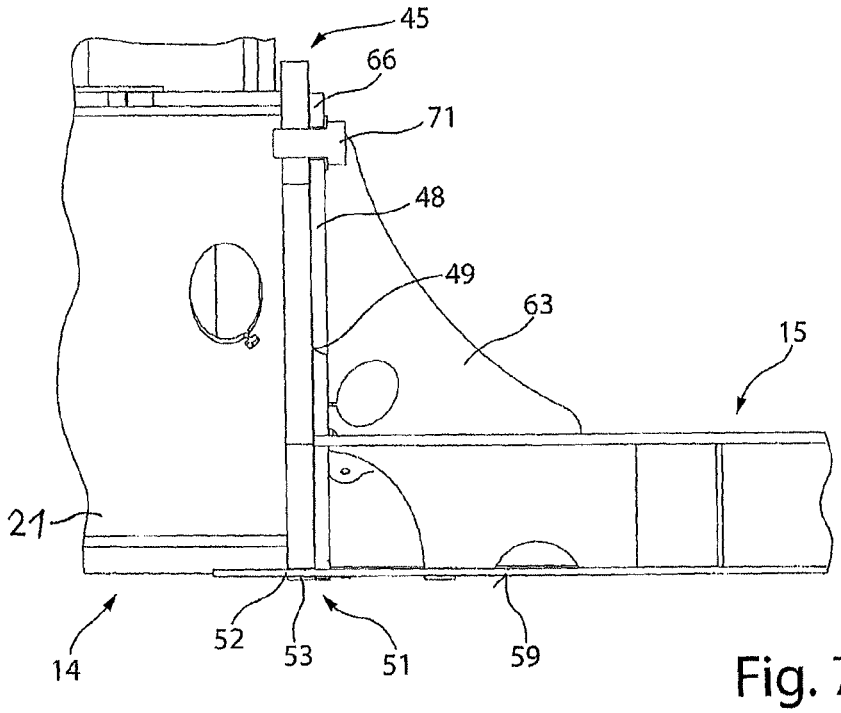

Such an orientation of the base assembly half 14 to the middle part 15 is discernable in FIG. 7. This FIG. 7 illustrates a schematic sectional view of a connecting point 45. In the lower region of the connecting point 45, the second connecting element 53 engages, in the first connecting element 52, on the base plate 59, to form the form-fit plug connection 51. On the opposite upper end of the connecting section 48, the at least one adjusting element 66 can be provided. Through the reduction or increasing of the distance, in the upper region of the connecting section 48, to the lateral surface 49, the longitudinal axis of the lifting device 24, in the angle to the middle part 15, is changed and adjusted.

Figure 8:
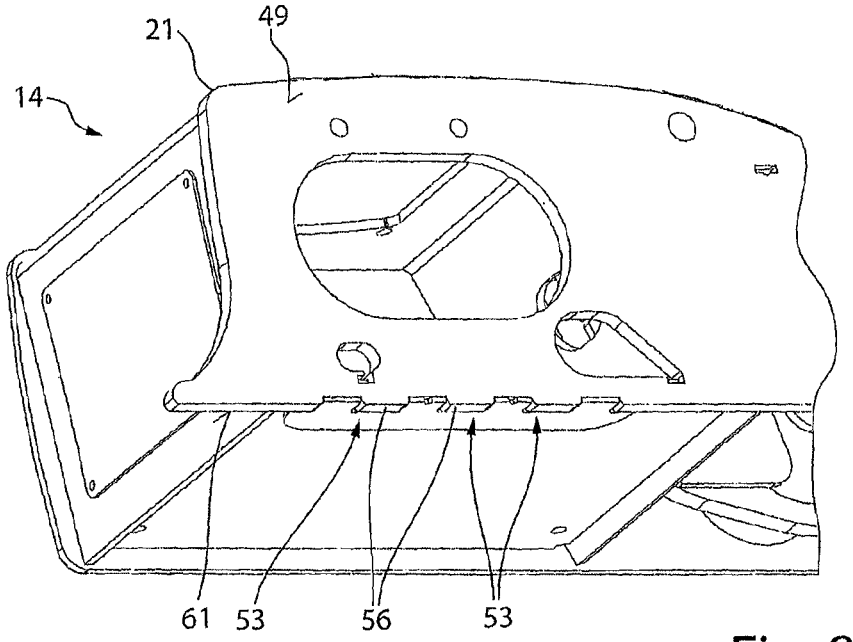

In FIG. 8, a perspective view onto a lateral surface 49 of the housing 21 in the region of the connecting point 45 is illustrated. The second connecting elements 43, in the form of webs 56, are directly provided on the lower end face 61 of the lateral surface 59. These are incorporated as one piece. The lateral surface 49 includes perforations to guide control lines and/or supply lines to the drive provided in the housing 21, insofar as the controller 41 is arranged on the opposite base assembly half 14.

Figure 9:
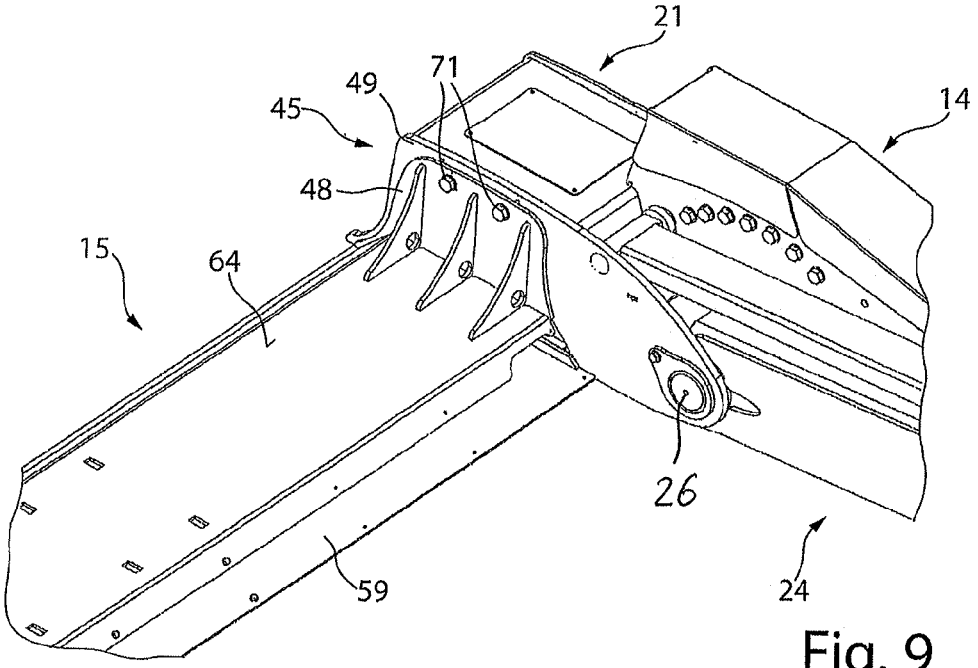
Figure 10:
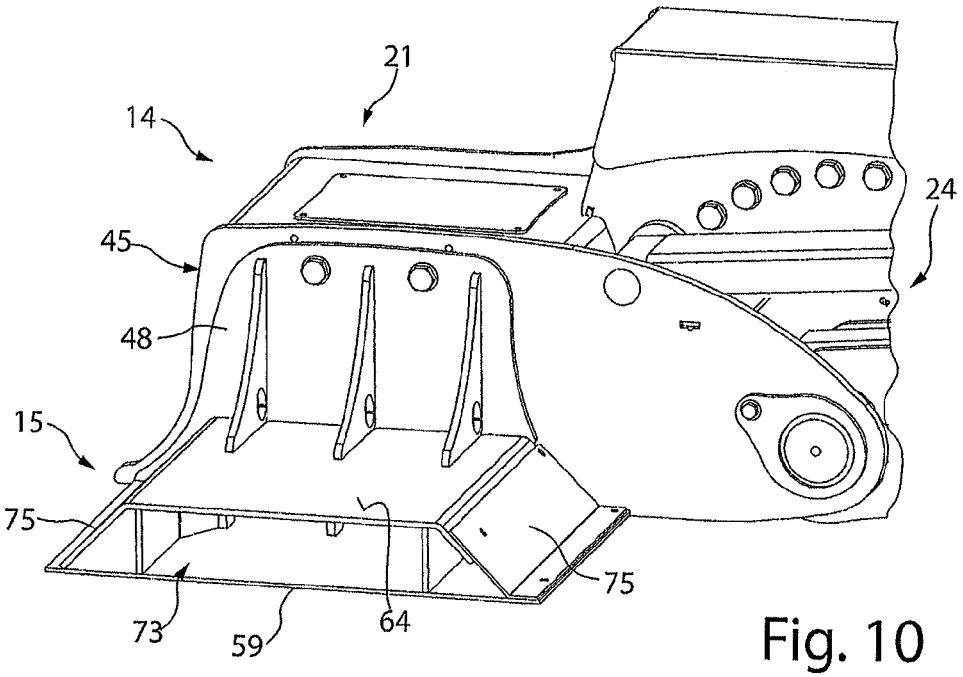

In FIG. 9, a perspective view from above is illustrated, and in FIG. 10, a perspective sectional view is illustrated. The middle part 15 is configured in a box-shaped manner. The box-shaped structure 73 is provided on the base plate 59, wherein, respectively, inclined entryway portions are configured between an upper side 64 and the base plate 59. These inclined entryway portions 75 also serve the end of configuring the middle part as traversable by a vehicle. The inclined entryway portion 75 can extend in sections or over the entire length of the middle part 15. These are preferably configured removably. A simple laying of the control and/or supply cables, in the middle part 15, can thereby be made possible.

Figure 5:
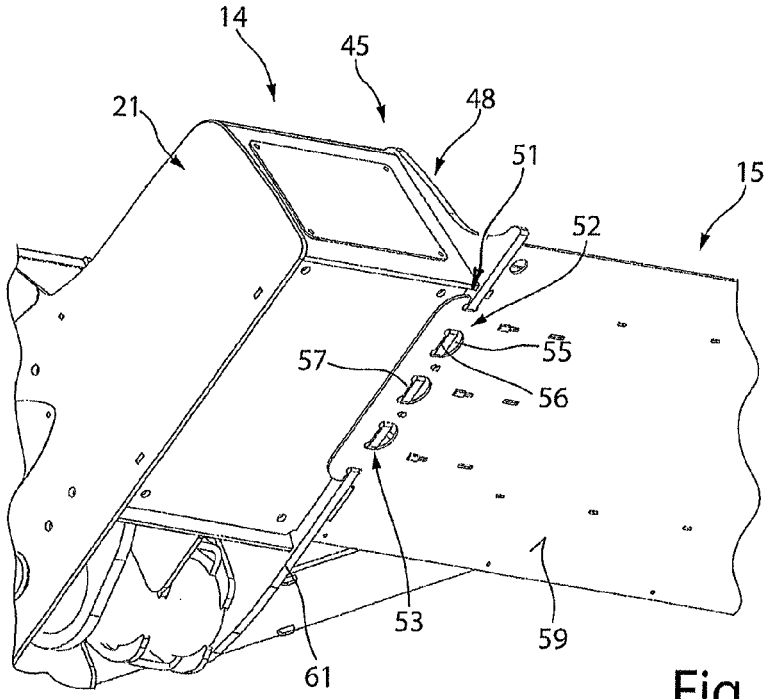
Figure 11:
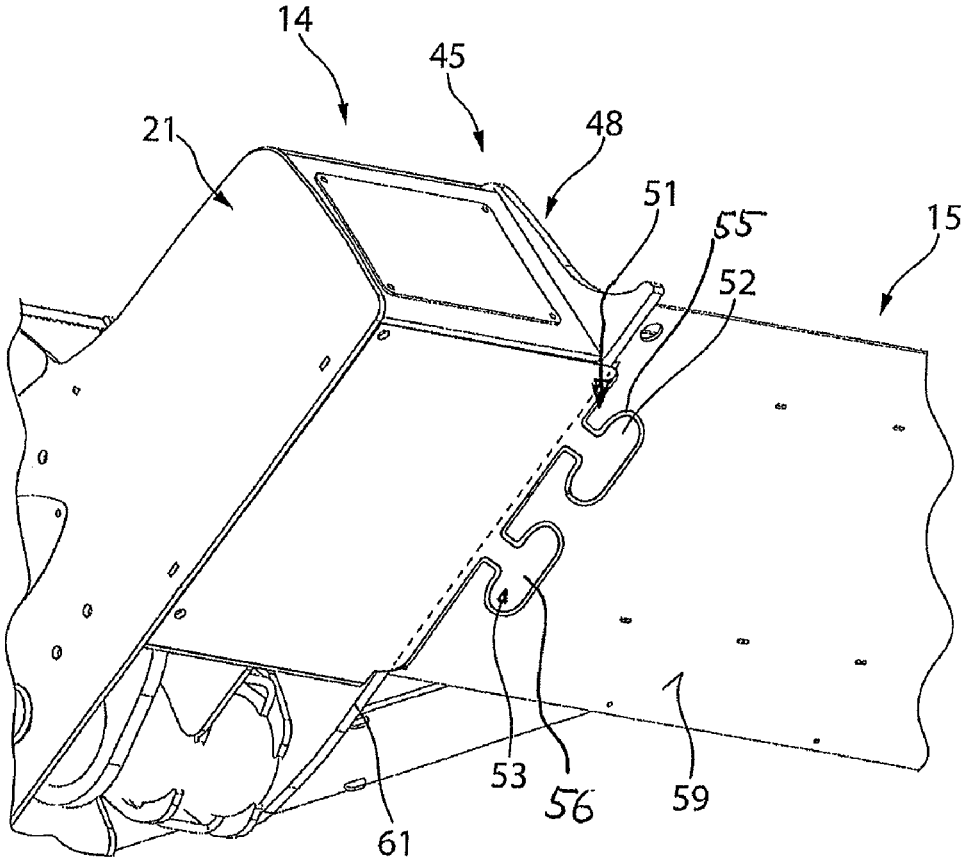

In FIG. 11, a perspective view of an alternative embodiment of a form-fit plug connection 52 for FIG. 5 is illustrated. In this embodiment, the first connecting element 52 is provided on a lower side of the middle part 15 in the base plate 59 and adjoins on the connecting section 48. The first connecting element 52 is, for example, configured as an open-edged opening 55. This first connecting element 52 does not extend beyond the connecting point 48. On a lower side of the housing 21, the second connecting element 53 is provided, which element extends outwardly from the lateral surface 49 of the housing 21. In this embodiment, the base assembly halves 14 are positioned on the base, and the middle part 15 can subsequently be placed on from above to form the form-fit material connection 51.

The geometry of the second connecting element 53 can be configured in the form of a hook 56, in particular in the form of a mushroom head or of a dovetail or otherwise hook-shaped, and engage in a complementarily configured first connecting element 52, and these together form the form-fit plug connection 51.

The invention claimed is:

1. A lifting platform, for lifting vehicles, comprising:

two base assembly halves, which are firmly arranged to one another respectively via a connecting point with a middle part, wherein the middle part is fastened, with a connecting section, detachably to a lateral surface of a housing of the base assembly half, to form the connecting point, a lifting device arranged respectively on the base assembly half, which is transferable from a starting position arranged on a floor into a working position and which respectively comprises a carrier at an end region of the lifting device and each carrier receives at least one support arm, wherein a first connecting element of the middle part is connected with a second connecting element on the respectively housing of the base assembly half with one another and aligned with respect to each other via a form-fit plug connection formed via insertion or hooking the first and second connecting element into one another.

2. The lifting platform according to claim 1, wherein the first connecting element is in a region end-facedly on the middle part, and wherein the second connecting element is on the lateral surface of the housing, of the base assembly half.

3. The lifting platform according to claim 2, wherein the connecting element forms the form-fit plug connection loadable on traction force.

4. The lifting platform according to claim 2, wherein one of the first and second connecting elements is formed by at least one web or hook and the other one of the first and second connecting elements is formed by a closed or open-edged opening or an eyelet, wherein the one of the first and second connecting elements form-fitly engages into the other one of the first and second connecting elements.

5. The lifting platform according to claim 2, wherein the first connecting element is provided on a lower side of the middle part, wherein the first connecting element protrudes outwardly from the connecting section, and the second connecting element is provided on the lower side of the housing.

6. The lifting platform according to claim 2, wherein the first connecting element is provided on a lower side of the middle part, wherein the first connecting element adjoins on the connecting section, and the second connecting element is provided on the lower side of the housing, wherein the second connecting element protrudes outwardly from the lateral surface of the housing.

7. The lifting platform according to claim 5, wherein the first connecting element arranged on the lower side of the middle part is configured as closed or open-edged opening or eyelet and the second connecting element arranged on an end face of the lateral surface of the housing is configured through webs or hooks.

8. The lifting platform according to claim 1, wherein the middle part comprises a base plate, and the first connecting element is integrally provided on the base plate.

9. The lifting platform according to claim 2, wherein the second connecting element is provided integrally on an end face of the lateral surface of the housing facing the floor.

10. The lifting platform according to claim 1, wherein the connecting section comprises a pressure surface on the middle part, wherein the pressure surface is arranged with distancing to the first connecting element arranged on the middle part.

11. The lifting platform according to claim 10, wherein the pressure surface on the middle part acts on an upper edge region of the lateral surface of the housing and counteracts a tilting moment of the base assembly half acting in a lifting of the vehicle.

12. The lifting platform according to claim 1, wherein, between the lateral surface of the housing of the base assembly half and the connecting section of the middle part, as well as distanced from the first and second connecting elements, at least one adjusting element is provided in the connecting point, through which an orthogonal orientation of the lifting device to the middle part is settable.

13. The lifting platform according to claim 1, wherein the middle part is respectively fixed, through detachable fastening means, with the housing of the base assembly half, which fastening means are provided, distanced to the first or second connecting element, on the connecting point.

14. The lifting platform according to claim 1, wherein the lifting device is configured as a parallelogram guiding device or as scissor guiding device, which includes a load arm and a guide arm and the lifting device receives the carrier respectively on an end region.

15. The lifting platform according to claim 1, wherein at least one drive is provided in or on at least one base assembly half, through which the lifting device is pivotably driven out of the starting position into the working position.

16. The lifting platform according to claim 5, wherein the second connecting element is provided on an end face of the lateral surface of the housing.

17. The lifting platform according to claim 1, wherein the lifting platform is provided as a movable lifting platform.

18. A lifting platform, for lifting vehicles, comprising:

two base assembly halves, which are firmly arranged to one another respectively via a connecting point with a middle part, wherein the middle part is fastened, with a connecting section, detachably to a lateral surface of a housing of the base assembly half, to form the connecting point, a lifting device arranged respectively on the base assembly half, which is transferable from a starting position arranged on a floor into a working position and which respectively comprises a carrier at an end region of the lifting device and each carrier receives at least one support arm, wherein the middle part is connected with the respective housing of the base assembly half with one another and aligned with respect to each other via a form-fit plug connection, wherein the form-fit plug connection includes at least a first connecting element in a region end-facedly on the middle part, as well as at least a second connecting element on the housing is on the lateral surface of the housing, of the base assembly half, wherein the second connecting element is configured complementarily to the first connecting element.

19. A lifting platform, for lifting vehicles, comprising:

two base assembly halves, which are firmly arranged to one another respectively via a connecting point with a middle part, wherein the middle part is fastened, with a connecting section, detachably to a lateral surface of a housing of the base assembly half, to form the connecting point, a lifting device arranged respectively on the base assembly half, which is transferable from a starting position arranged on a floor into a working position and which respectively comprises a carrier at an end region of the lifting device and each carrier receives at least one support arm, wherein the middle part is connected with the respective housing of the base assembly half with one another and aligned with respect to each other via a form-fit plug connection, wherein the connecting section comprises a pressure surface on the middle part, wherein the pressure surface is arranged with distancing to a connecting element arranged on the middle part, wherein the pressure surface on the middle part acts on an upper edge region of the lateral surface of the housing and counteracts a tilting moment of the base assembly half acting in a lifting of the vehicle.

* * * * *